United States Patent [19]

Pollard

[11] 3,963,224

[45] June 15, 1976

[54] GAS SHROUD

[75] Inventor: Bernard Robert Pollard, Aliquippa, Pa.

[73] Assignee: Jones & Laughlin Steel Corporation, Pittsburgh, Pa.

[22] Filed: July 30, 1975

[21] Appl. No.: 600,330

[52] U.S. Cl. ..... 266/207; 164/66; 164/259; 266/217

[51] Int. Cl.[2] ..... B22D 11/10

[58] Field of Search ..... 266/34 V, 38; 164/66, 164/82, 259, 281, 337, 412; 206/207, 217, 236

[56] References Cited

UNITED STATES PATENTS 3,439,735 4/1969 Holmes ..... 164/259

*Primary Examiner*—Roy Lake
*Assistant Examiner*—Paul A. Bell
*Attorney, Agent, or Firm*—Gerald K. White; T. A. Zalenski

[57] ABSTRACT

An improved shrounding apparatus for providing a protective gaseous atmosphere around a liquid stream during its transfer between containers is characterized by a releasable shroud head and a positioning system that includes at least two pivot members. The device is specially suitable for use in the continuous casting of liquid metals such as steel.

4 Claims, 5 Drawing Figures

GAS SHROUD

The invention pertains to an improved shrouding apparatus of the type generally described in my prior U.S. patent application Ser. No. 337,999, filed Mar. 5, 1973, now U.S. Pat. No. 3,908,734, and in its corresponding Luxembourg Pat. No. 69,454, granted on May 29, 1974. This invention may be used and operated in the same manner disclosed in my prior application. For reasons set forth more fully below, the shrouding device of this invention contains several structural features and relationships that lead to improved operational flexibility.

The invention includes shrouding apparatus for use in combination with transfer vessels such as a tundish and mold when used for the continuous casting of liquid steel. The shrouding device is characterized by a shroud head having a gas filled, open-ended tube that is positioned between the transfer vessels in a manner that permits a liquid to be passed from the dispensing vessel through the tube and into the collecting vessel. A protective gas is introduced into the open-ended tube portion of the shroud head from an interconnecting second tube. The shroud head is adapted to be releasably connected to and in substantially sealed relationship with an end member into which the protective gas in introduced. The end member, in turn, is supported by and connected to a positioning system which includes at least two pivot points.

It is thus an objective of the invention to provide a shrouding device that is constructed in such a manner so as to enhance operational flexibility.

It is a further objective to provide a shroud assembly in which the shroud head is readily detachable from the balance of the apparatus thereby facilitating shroud assembly prior to and during performance of the shrouding process.

It is yet another objective to provide a positioning system that improves the ability of an operator to position the shroud between containers prior to and during the course of the shrouding process.

These and other objectives and advantages will become apparent to those skilled in the art from the following description of the invention.

The improved shrouding device comprises three basic structural components. They are: a shrouding head, an end member and a linkage positioning member containing at least two pivot points. Operating flexibility is achieved by the combination of said three components in the sense that shroud assembly or positioning is improved compared to the device depicted in my aforesaid prior application.

Figure 1:
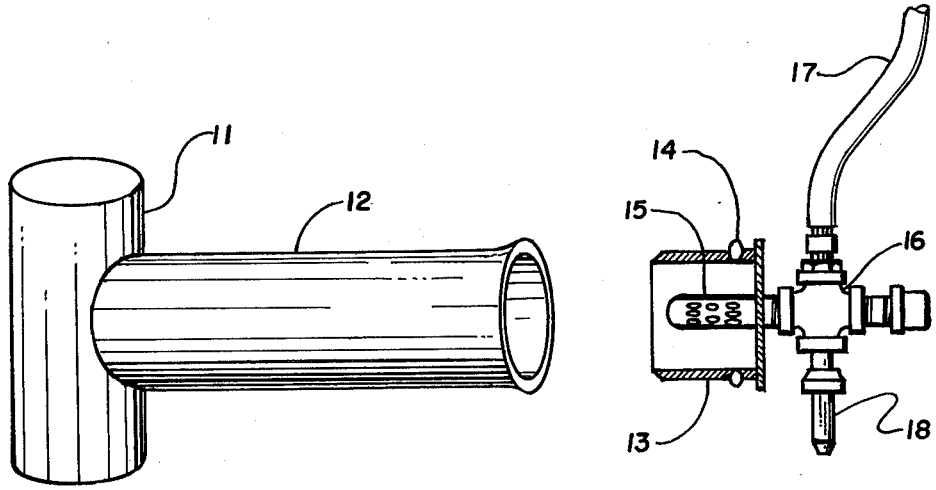
FIG. 1 depicts a shroud head and end member prior to assembly.

FIG. 1 is illustrative of an improved construction of the protective gas system. Because of the nature of the system, a shroud head may be easily and rapidly replaced while the transfer process is in progress without the necessity for releasing its tubular members from the positioning means or disconnecting the gas supply means. Such facilitation of replacement leads to the ability to minimize the time interval in which stream protection is lost due to temporary removal of the shrouding system.

FIG. 1 illustrates the interrelationship of the shroud head and end member. The shroud head generally comprises open-ended tubular member 11 and tubular member 12. In operation, liquid material such as steel falls through tubular member 11 during its passage from a distribution vessel such as a tundish to a collection vessel such as a mold. The distribution and collection vessels are conventional and, hence, are not illustrated in FIG. 1. In operation, tubular member 11 is positioned between the transfer vessels so as not to contact either vessel. This permits the shrouding device to be moved in and out of position prior to, during, and after the process. Tubular members 11 and 12 are joined as indicated so as to form an interconnecting passageway for the flow of protective gas from member 12 into member 11 and subsequently from each of its open ends. Tubular members 11 and 12 are preferably made from a light gage steel such as from about 1/64 inch to about 1/16 inch in thickness so as to facilitate handling and replacement. Such thicknesses are capable of being moved through liquid steel streams without damage. The end of tubular member 12 opposite to the open end joined with member 11 is preferably flanged so as to accommodate its fit around the circumference of end member 13. Of course, tubular member 12 could also be dimensioned to fit into the interior of end member 13 if desired. End member 13 should be dimensioned so that it will fit in a snug, but releasable manner against tubular member 12. In this manner, the respective components may be rapidly assembled and disassembled by hand. Preferably end member 13 contains a raised area on its circumference that acts as a stop for tubular member 12. Despite the releasable nature of the fit, members 12 and 13 are also placed in substantially sealed relationship so as to minimize the possibility of air entrainment into the system. This may be conveniently accomplished by the use of sealing member 14. Such member may include a heat-resistant gasket or tube or the like. End member 13 may also contain diffuser 15 so as to promote gas flow uniformity. Support member 16 may be attached to end member 13 and gas delivery means 17 as illustrated. Gas delivery means 17 is capable of delivery either inert or reducing protective gases. Pivot member 18 in the form of a rod or the like is inserted into support member 16 so as to enable the shroud to be pivoted around member 18 when the shroud is positioned. Pivot member 18 is not fixed independently or to either transfer vessel and thereby its movement is solely a function of the location of fixed pivot member 31 (shown in FIG. 3).

Figure 2:
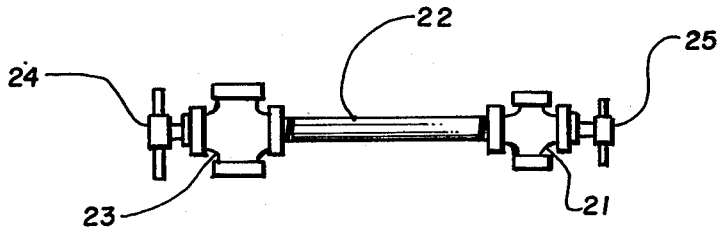
FIG. 2 is an illustration of a portion of the linkage of the positioning system.

FIG. 2 depicts a portion of a linkage system that may be utilized in the positioning system. Support member 18 is inserted into holding member 21 and secured in place with use of securing means 25 which may comprise a pin or rod which is screwed to hand tightness against pivot member 18 so as to prevent movement of the shroud upon positioning. Subsequent shroud movement is accomlished by either loosening securing means 25 or moving the shroud assembly with sufficient force to overcome the securing action. Linkage arm 22 connects holding members 21 and 23 so as to provide for the inclusion of two pivot points in the overall positioning system. The use of two pivot points enables the device to be pivoted throughout a full 360° arc from each of two points. This naturally improves the positioning flexibility of the device when contrasted with the movement obtained with use of only a single pivot point. Flexibility is also enhanced by the ability to lock a given pivot member at a fixed position and then move the device around one point. This aspect is particularly advantageously employed when substituting a new shroud head during the process. Although more that two pivot points may be utilized, two points are preferred because of simplification considerations. Securing means 24 functions to secure contact of shaft 31 (shown in FIG. 3 only) and holding member 23. Shaft 31 is inserted into the interior of holding member 23. Securing means 24 is similar to securing means 25 in construction and mode of operation.

Figure 3:
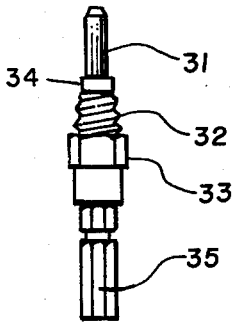
FIG. 3 illustrates one of the pivot members of the positioning system.
Figure 4:
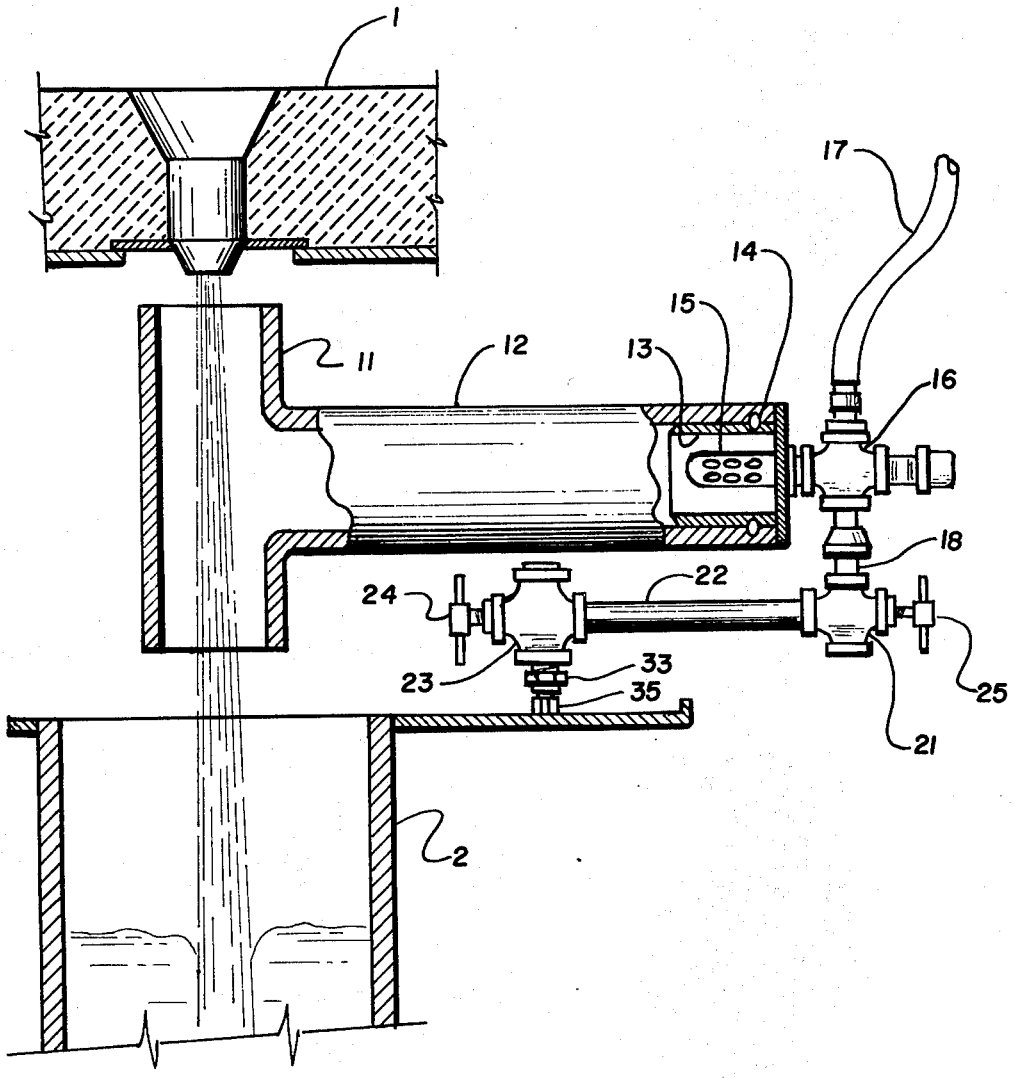
FIG. 4 illustrates an assembled shroud operationally positioned between tundish 1 and mold 2 and affixed to the mold.
Figure 5:
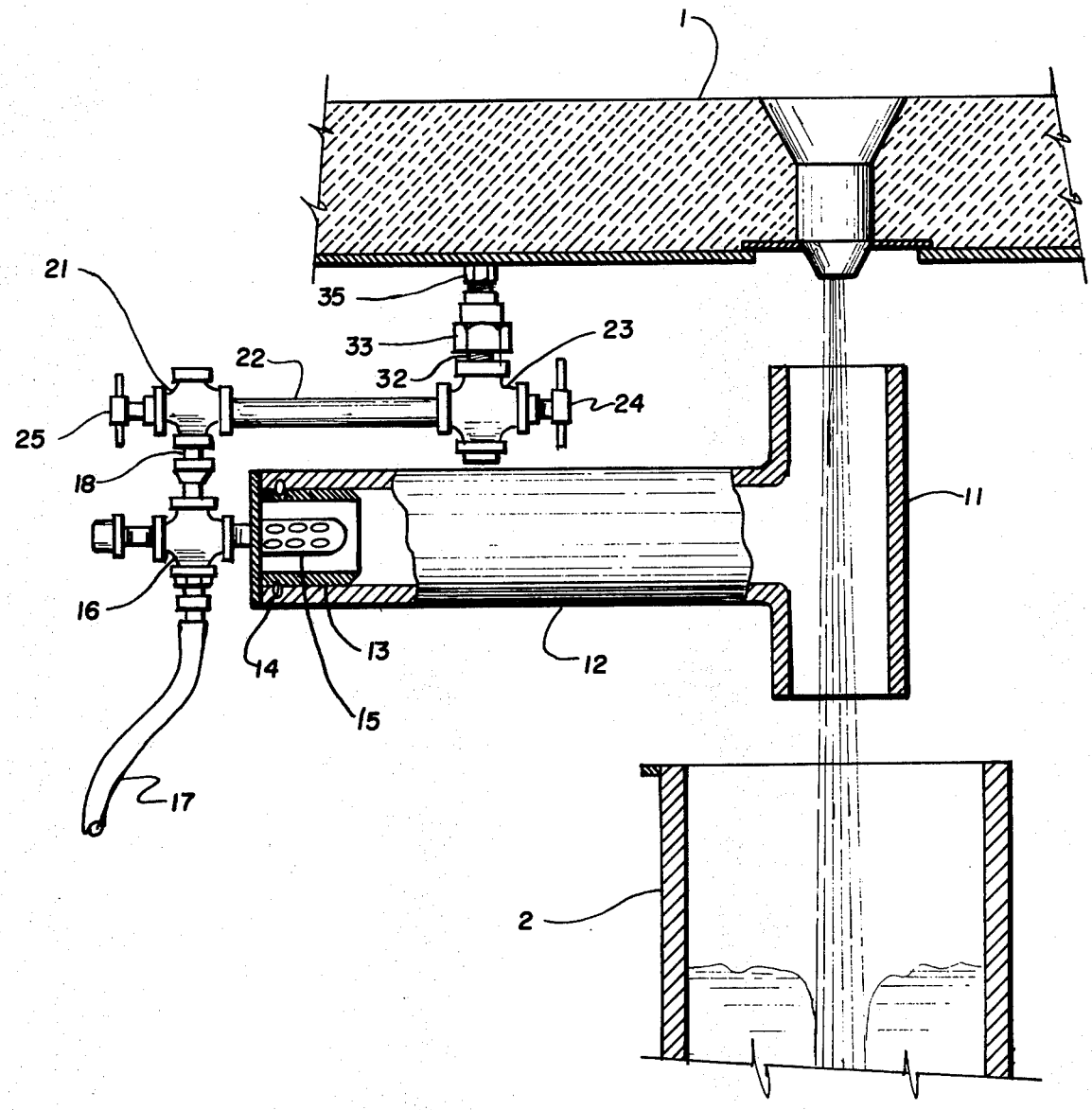
FIG. 5 depicts an assembled shroud operationally positioned between tundish 1 and mold 2 and affixed to the tundish.

FIG. 3 provides a view of a preferred type of fixed pivot member. Shaft 31 is inserted into holding member 23 thereby permitting the positioning system and shroud to be pivoted about shaft 31. Stop area 34 serves to support holding member 23 and thus the balance of the assembly at a given height. A typical support area or means may advantageously comprise nut 33 which may be raised or lowered by rotation around threaded surface 32. Such arrangement facilitates adjustment of the location of the shroud head between the transfer vessels. The lower portion of the pivot member contains keyway 35 that enables the pivot member to be fixed with respect to rotary movement through the expedient of the insertion of a pin or the like. This ensures that holding member 23 will rotate about the pivot member.

The above described shrouding system constitutes an improvement from the standpoint of assembly of the shroud prior to its use and its use during the transfer process when contrasted with my shrouding system in the aforementioned application and patent.

During initial set-up, the fixed pivot member is merely inserted into an appropriate holding location and the linkage system and end member assembled thereto. Then the lightweight shroud head is placed in releasable contact with the end member with the use of light pressure. Because there are at least two pivot points in the positioning means, obviously a much greater degree of positioning flexibility exists than if only one pivot point were used. This factor is important whenever obstacles such as tundish ribs, etc. would otherwise impede the positioning of the shroud.

Shroud head replacement during the process is also facilitated by the invention. One merely needs to remove the shroud head by passage through the liquid transfer stream, release the head and replace it with a new head, and operatively reposition the shroud. The rapidity and simplicity of replacement minimizes the time period during which the transfer stream is unprotected and thereby serves to upgrade the overall quality of the product of the process.

I claim:

1. In the combination of shrouding apparatus for establishing and maintaining a protective gaseous atmosphere around a liquid stream during its transfer between distribution means comprising a first container having a liquid exit opening for passing the liquid stream through said shrouding apparatus and into collection means comprising a second container having a liquid entry opening, wherein the improvement comprises:

shrouding apparatus comprising a. a shroud head having an open-ended tubular member positioned between said first and second containers without contacting said first and second containers and a second tubular member having an open end and its other end connected with said first tubular member so as to form an interconnecting passageway for the passage of a protective gas between said tubular members;

b. an end member releasably connected to and in substantially sealed relationship with the open end of said second tubular member, said end member supported by and connected to linkage positioning means comprising at least two pivot points for positioning said shroud head between said first and second containers; and c. gas delivery means for passing a protective gas into and through said end member and, thereafter, through said second and first tubular members so as to cause the protective gas to exit from the open ends of said first tubular member.

2. The improvement set forth in claim 1, wherein: said positioning means being affixed to said first container.

3. The improvement set forth in claim 1, wherein: said positioning means being affixed to said second container.

4. The improvement set forth in claim 1, wherein: said linkage positioning means further comprising a first pivot member attached to said end member and in pivotal contact with a first linkage member which in turn is in pivotal contact with a second pivot member.

* * * * *